US006237685B1

(12) United States Patent
Surinak

(10) Patent No.: US 6,237,685 B1
(45) Date of Patent: May 29, 2001

(54) BOLT-ON WELL ADAPTER

(76) Inventor: John J. Surinak, 2 Earling Ct., Oconomowoc, WI (US) 53066

( * ) Notice: Subject to any disclaimer, the term of this patent is extended or adjusted under 35 U.S.C. 154(b) by 0 days.

(21) Appl. No.: 09/182,406

(22) Filed: Oct. 29, 1998

(51) Int. Cl.[7] ..... E21B 19/00; E21B 33/00; F16L 5/00

(52) U.S. Cl. ..... 166/85.2; 166/88.1; 166/88.4; 166/242.1; 285/197

(58) Field of Search ..... 166/85.2, 88.1, 166/88.4, 242.6, 242.1; 285/197, 198, 199

(56) References Cited

U.S. PATENT DOCUMENTS

| | | | | |
|---|---|---|---|---|
| 2,707,030 | * | 4/1955 | Ortman | 166/85.2 |
| 2,918,972 | * | 12/1959 | Tubbs | 166/85.2 |
| 2,949,961 | * | 8/1960 | Anderson | 166/85.2 |
| 2,960,166 | * | 11/1960 | Haydin et al. | 166/85.2 |
| 2,968,256 | * | 1/1961 | Williams | 417/238 |
| 3,324,950 | * | 6/1967 | Andrew | 166/85.2 |
| 3,430,697 | * | 3/1969 | Wellstein | 166/85.2 |
| 3,434,536 | * | 3/1969 | Tubbs | 166/85.2 |
| 3,467,181 | * | 9/1969 | Maass | 166/85.2 |
| 3,561,796 | * | 2/1971 | Williams | 258/106 |
| 3,645,333 | * | 2/1972 | Maass | 166/85.2 |
| 3,718,185 | * | 2/1973 | Wellstein | 166/85.2 |
| 3,797,571 | * | 3/1974 | Hamar | 166/85.2 |
| 3,805,891 | * | 4/1974 | Reinhard et al. | 166/85.2 |
| 3,958,632 | | 5/1976 | Buchman et al. | 166/85.2 |
| 4,056,144 | * | 11/1977 | Wellstein | 166/85.2 |
| 4,073,513 | * | 2/1978 | Blakeley | 285/197 X |
| 5,006,044 | * | 4/1991 | Walker, Sr. et al. | 417/12 |
| 5,149,144 | * | 9/1992 | Blakeley | 285/197 X |
| 5,746,273 | * | 5/1998 | Surinak | 166/85.2 |

* cited by examiner

*Primary Examiner*—Eileen D. Lillis
*Assistant Examiner*—Jong-Suk Lee
(74) *Attorney, Agent, or Firm*—Andrus, Sceales, Starke & Sawall, LLP

(57) ABSTRACT

Secured to an exterior surface of a well casing having an aperture formed therein is a first unit including a horizontal fluid passage receiving a horizontal pipe and extending through a generally annular seat in registration with the aperture. A second unit is disposed within an interior surface of the wall casing for supporting a vertical pipe and pump assembly and includes a generally planar flange adapted to be slidably received in a blind channel of the first unit at an angle relative to the longitudinal axis of the well casing so as to provide a continuous fluid passage between the vertical pipe and the horizontal pipe. The annular seat of the first unit is completely recessed from the inner surface of the well casing such that upon release of the second unit from the first unit, the second unit and its pump assembly are movable in a totally obstruction-free path through the interior surface of the well casing. The external unit has internal structure and a sealing arrangement disposed outside the aperture between an inner surface of the external unit and the exterior surface of the well casing cooperable to signal a fluid warning upon damage and destruction to at least the sealing arrangement.

7 Claims, 2 Drawing Sheets

BOLT-ON WELL ADAPTER

FIELD OF THE INVENTION

The present invention relates broadly to pumping systems for sanitary water wells and, more particularly, pertains to a bolt-on well adapter mounted to the well casing for connecting the flow pipe of a submersible pump with a water supply pipe leading from the well casing.

BACKGROUND OF THE INVENTION

In U.S. Pat. No. 3,958,632, issued May 25, 1976 to Buchman et al, a well pipe connector is provided for connecting a horizontal pipe outside a hollow well casing to a vertical pipe extending in the casing. The connector has a first or external unit for external connection to the horizontal pipe in which the first unit is externally secured to the casing over an aperture with a hollow sleeve extending therethrough in alignment with the aperture. Extending into the aperture is an annular seat, the lower periphery of which rests upon a lower edge of the aperture wall with the remainder of the periphery being generally flush with the inner surface of the casing. A blind channel extends from an upper seat edge downwardly and at an angle outwardly away from the casing exterior. A second or internal unit disposed within the well casing has an angled fluid passage with one end connected to the vertical pipe and the other end extending through a planar flange adapted to be slidably received in the blind channel of the first unit. The flange is positioned at an angle with respect to the wall of the well casing such that insertion of the flange into the channel to connect the first and second units will support the passage and align it with the hollow sleeve with the one end in vertical downward position. A single flattened gasket is placed between the periphery of the first unit and the exterior of the well casing to create a fluid tight seal therebetween.

As is well known, a vertical pipe or bar is used to lower the above-described second unit with its supported pipe and pump into the well casing so as to couple the first and second units together. In the course of lowering the well connector components (pump p, pump wires, etc.), a protrusion on the fixed upper portion of the first unit annular seat acts as an obstruction within the well casing interior causing damage to the well connector components. A similar problem occurs when it is desired to lift the well connector components out of the well casing for inspection and repair. In addition, the single gasket employed in Buchman et al '632 patent between the periphery of the first unit and the exterior surface of the well casing is disposed in such a manner that the gasket is liable to wear in an accelerated fashion and may cause premature leakage of water from the well casing.

Accordingly, it is desirable to provide a well adapter constructed and arranged so that the well components can be moved during installation and servicing without damage within the interior of the well casing. It is also desired to provide a well adapter having improved sealing capability at the interface between a bolted-on external unit and the exterior surface of the well casing. It is further desirable to provide a well adapter having an early warning detection system for monitoring leakage between the external unit and the well casing.

BRIEF SUMMARY OF THE INVENTION

In one aspect of the invention, a well casing has a longitudinal axis, an exterior surface, an interior surface and an aperture formed therein. A first unit is secured to the exterior surface of the well casing and includes a horizontal fluid passage receiving a horizontal pipe and extending through a generally annular seat in registration with the aperture. A second unit is disposed within the interior surface of the well casing for supporting a vertical pipe and a pump assembly. The second unit includes a generally planar flange adapted to be slidably mounted in a blind channel of the first unit at an angle relative to the longitudinal axis of the well casing to provide a continuous fluid passage between the vertical pipe and the horizontal pipe. The annular seat of the first unit is completely recessed from the inner surface of the well casing such that upon release of the second unit from the first unit, the first unit and its pump assembly are movable in a totally obstruction-free path throughout the interior surface of the well casing. In the preferred embodiment, the angle between a plane passing through the blind channel and the annular seat and the longitudinal axis of the well casing is in the range of 22° to 25°. The first unit includes a curved lip engaged against the exterior surface of the well casing and forming an annular pocket lying outside the aperture formed in the well casing A pair of concentric gaskets are retained in the pocket to define a fluid-tight seal between the first unit and the well. The first unit further includes a port connecting the horizontal fluid passage with the pocket such that fluid in the horizontal passage is communicated to a space between the concentric gaskets retained in the pocket. The lip, the pocket, the concentric gaskets and the fluid port collectively define an early warning leak detection arrangement constructed and arranged to signal a fluid warning upon damage and destruction to at least one of the concentric gaskets and the engagement of the lip against the exterior surface of the wall casing. The annular seat has a lower periphery with a lip which seats in the rim of the aperture, and an upper periphery which extends to the rim of the aperture and lies spaced from the inner surface of the well casing.

In another aspect of the invention, a well adapter used in a well casing formed with an aperture has an exterior surface and interior surface and is equipped with a pump. The well adapter includes an external unit removably secured to the exterior surface of the well casing and includes a sleeve having a horizontal fluid passage receiving a horizontal pump and extending through a generally annular seat in registration with the aperture. The annular seat has a blind channel formed therein and extends at an angle downwardly and outwardly relative to the exterior surface of the well casing. An internal unit is disposed within the interior surface of the well casing for supporting a vertical pipe to which the pump is connected and includes a generally planar flange adapted to be slidably received in the blind channel of the external unit at the angle of the blind channel. The upper periphery of the annular seal lies completely recessed from the inner surface of the well casing so as to create a totally obstruction-free path for the pump during installation and repair. The external unit has internal structure and a sealing arrangement disposed outside the aperture between an inner surface of the external unit and the exterior surface of the well casing cooperable to signal a fluid warning upon damage and destruction to at least the sealing arrangement.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
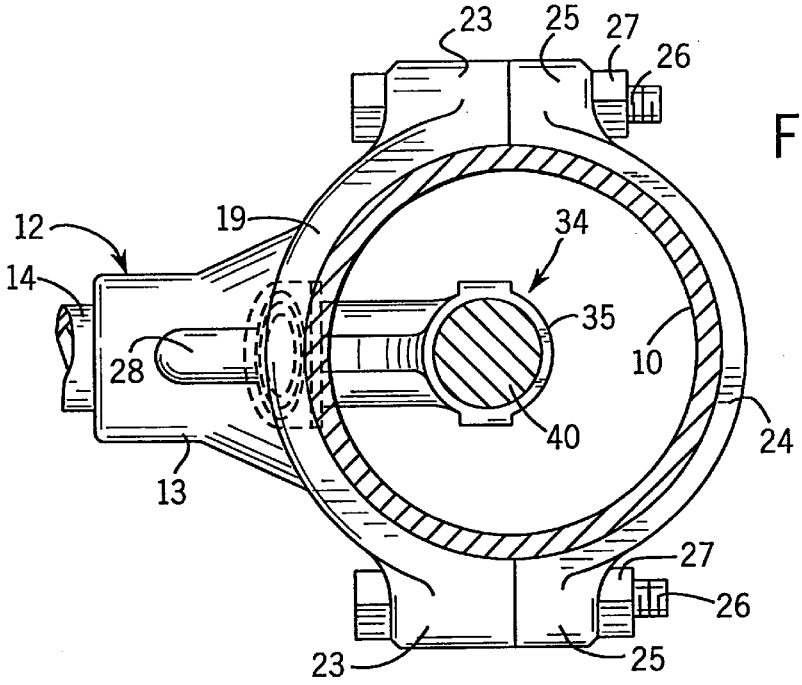
FIG. 1 is a top view of a well casing with external and internal units of the well adapter embodying the present invention as the casing and adapter would be seen looking down from the ground level.
Figure 2:
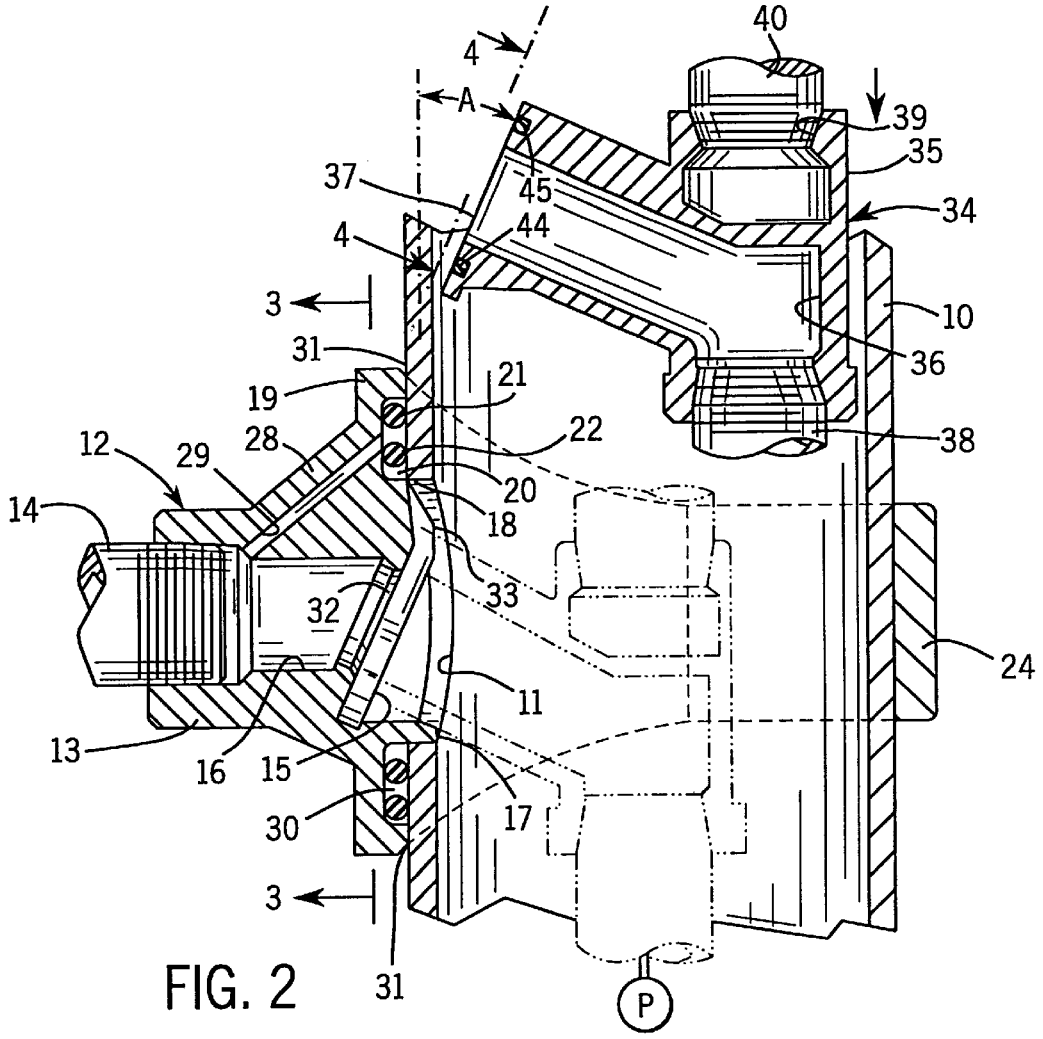
FIG. 2 is a cross-sectional view through a section of the well casing showing the well adapter as it is about to be assembled to connect horizontal and vertical well pipes.

Referring first to FIGS. 1 and 2, a section of a well casing 10 is shown with the well adapter unit of this invention attached thereon. The well casing 10 is typically a steel pipe of four to twelve inches in diameter embedded vertically in the ground and extending downwardly into the well. Positioned below the frost line is a lateral aperture 11, best seen in FIG. 2, which extends through the wall of the well casing 10 to provide for attachment of a portion of the well adapter of this invention. A first or external unit of the well adapter, generally designated by reference numeral 12, includes a sleeve 13 having interior threads for attachment to a horizontal water discharge pipe 14 which leads from the well to a house or other structure. Extending inwardly from the sleeve 13 is an annular seat 15, best seen in FIG. 2, which includes a lateral passage 16 coaxial with the sleeve 13 to provide a water passage through the entire first unit 12. The annular seat 15 has a lower portion 17 with an external supporting lip which rests upon the rim of the aperture 11. In accordance with one feature of the invention, the annular seat 15 has an upper portion 18 which lies completely recessed from the inner surface of the well casing 10 when the first unit 12 is in position relative thereto. As will be further appreciated hereafter, the structure and disposition of the upper portion 18 of the annular seat 15 relative to the wall forming aperture 11 enables a completely obstruction-free passage of the submersible pump, pipe and power wires along the inner surface of the well casing 10 during installation and servicing.

On the outside wall of well casing 10, a curved lip 19 extends around the periphery of annular seat 15 and is recessed on an inside face thereof to form an annular pocket or ring 20 having a diameter slightly larger than aperture 11. A pair of concentric, resilient gaskets 21,22 is placed within the pocket 20 formed in lip 19 to create a seal between the inside face of external unit 12 and the outside face of well casing 10. As seen in FIG. 1, lip 19 wraps in an arc around an exterior portion of well casing 10, so that the gaskets 21 and 22 are both forced to assume a position against the well casing periphery when the external unit 12 is clamped thereon. Whereas in the prior art, the single sealing gasket was exposed to the external environment and subject to greater wear, the lip 19 of the present invention, in the installed condition of FIG. 2, contacts the casing exterior and completely encases both gaskets 21 and 22 so as to provide a better seal. In addition, the placement of the gaskets 21 and 22 in the pocket 20 and against the well casing 10 rather than in the aperture 11 also improves the sealing capability over the prior art.

A yoke 23 extends outwardly from lip 19 on each lateral side of the annular seat 15 to provide a device for securing external unit 12 to wall casing 10. The attaching device in the preferred embodiment is a U-shaped bracket 24 which wraps around the remaining portion of the well casing 10. Bracket 24 has a pair of ears 25 which are aligned with the yokes 23 on external unit 12, so that suitable fasteners, such as bolts 26, may be passed through holes formed in the yokes 23 and the ears 25. Each end of bolt 26 is threaded to receive a nut 27 which, when drawn tight, will securely draw the external unit 12 towards casing 10 to provide a fluid-tight seal around aperture 11 by means of the gaskets 21 and 22. Such design is particularly advantageous in disposing the adapter anywhere along the casing 10 where an aperture 11 is located without requiring special attachments or fittings.

It should be appreciated that the structure afforded by the pair of concentric gaskets 21 and 22 provides an effective fluid-tight seal, so that fluid being pumped from the well to discharge pipe 14 will not normally leak from the surface between the casing exterior and the inside face of external unit 12. However, in accordance with a further feature of the invention, provision is made to detect early signs of fluid leakage such as caused by wear or damage to the gaskets 21 and 22. In this regard, external unit 12 includes a bridge portion 28 extending from the discharge pipe 14 to the uppermost point on the lip 19. Bridge portion 28 is internally formed with an angled port 29 which communicates the interior of discharge pipe 14 with an annular space 30 between the gaskets 21 and 22. With this feature, a portion of fluid being discharged through pipe 14 will be conducted or back fed via port 29 to the space 30 such that if any fluid is visually detected seeping from the interface 31 between lip 19 and well casing 10, it will signal that a closer inspection of the gaskets 21 and 22 is necessary.

Figure 3:
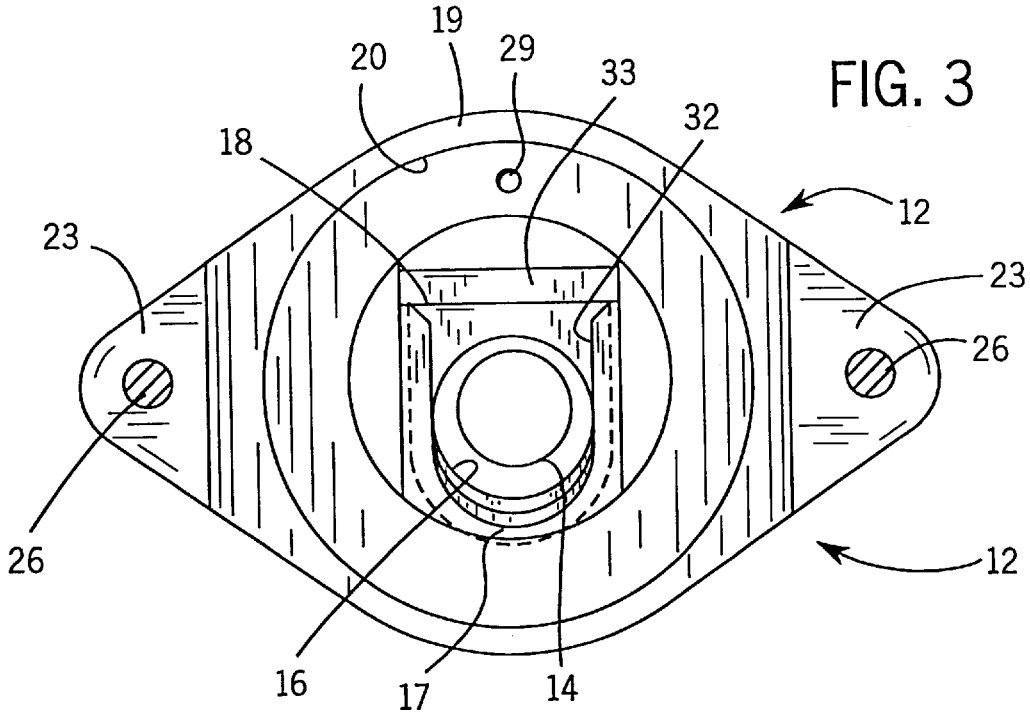
FIG. 3 is a cross-sectional view taken along line 3—3 of FIG. 2 showing the details of the structure of the annular seat and the external unit of the well adapter.

Referring again to FIG. 2, a blind passage or slot 32 extends downwardly into the annular seat 15 from the upper portion 18 to the lower portion 17. The slot 32 opens at the top in a relieved area 33, and terminates at the bottom in the lower portion 17 in a position spaced from the interior edge of the lower portion 17 and outside of the casing 10 when the external unit 12 is mounted thereon. As is best seen in FIG. 3, the slot or passage 32 forms an open channel extending on either side of the passage 16 which is designed to slidably receive a second or internal unit of the adapter, designated as reference numeral 34 and shown in FIG. 4. The slot or passage 32 extends at an angle to the axis of the well casing 1 as best seen in FIG. 2. In the preferred embodiment described therein this angle, designated as A in FIG. 2, is approximately 22° to 25°.

Figure 4:
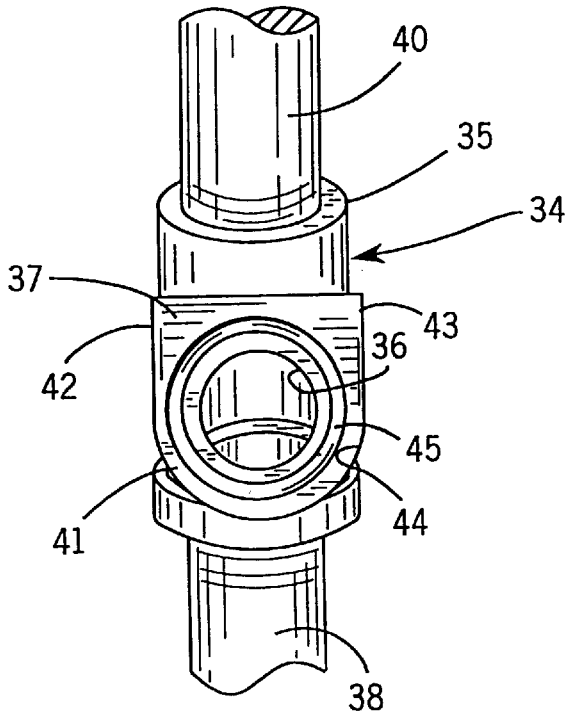
FIG. 4 is an elevational view taken on line 4—4 of FIG. 2 showing details of the structure of a portion of the internal unit of the well adapter.

The second or internal unit 34, best seen in FIGS. 2 and 4, includes a body 35 having an angled fluid passage 36 extending from the lower surface thereof upwardly and hence laterally through a flange 37. The lower end of the passage 36 is threaded to receive a vertical well pipe 38. As is well known to those skilled in the art, the vertical well pipe 38 supports the entire internal well system and pump p so that the strength of the second unit 34 and its threaded area must be substantial. For convenience in handling the adapter unit from above the ground, a blind hole 39 is threaded to receive a bar 40 which can be inserted from above the ground to attach or detach the unit as will be described below.

The flange 37 on the second or internal unit 34 is positioned at an angle to the axis of the lower portion of the fluid passage 36, as shown in FIG. 2, and is supported by bar 40 of relatively heavy construction which surrounds the lateral portion of the passage 36. As seen in FIG. 2, the angle between the plane of the flange 37, and the axis of the lower portion of the passage 36, and thus the axis of the well casing 10, is the same angle A (preferably 22° to 25°), so that when the flange 37 is placed within the slot 32 of the first unit 12, the lower end of the passage 36 and thus its vertical pipe 38 are placed in vertical position, parallel to the axis of the casing 10. Referring to FIG. 4, the flange 37 includes a generally rounded lower edge 41 with tangentially straight sides 42 and 43 adapted to be slidingly received in the blind slot or passage 32.

FIG. 2 shows the first and second units 12 and 34 of the well adapter about to be assembled. As described, the bar 40 can be used to lower the second unit body 35 and the supported pipe 38 into the well casing 10 into the position shown in FIG. 2. In this position, continued downward movement by the operator will cause the lower edge 41 of the flange 37 to be guided into the passage 32 by the relieved area 33. As the flange 37 moves into the passage 32, the pipe 38 is positioned in vertical alignment with the casing 10 due to the fact that the angle from vertical of both the flange 37 and slot 32 are the same. Continued downward movement will cause the flange 37 to seat fully within the passage 32 to support the second unit 34 and its water pipe 38. Because the weight of the pump p and water pipe 38 is substantial, increasing as the depth of the well increases, it is desirable that the lower section 41 below the flanged area 37 be of substantial strength and be adapted to rest upon the lower portion 17 of the annular seat 15 of the first unit 12. This takes a considerable portion of the forces off the sides of the flange 37 itself, so that the flange is 37 used primarily to guide the unit into position where it is supported with the lower edge 41 resting upon the lower portion 17 of the annular seat 15. As previously pointed out, the lower edge of the lower portion 17 of the annular seal 15 rests upon the rim of the aperture 11 and the pipe casing 10 to support the entire unit and thus not place an undue strain on the U-bracket 24 or other portions of the first unit 12.

To provide a fluid tight seal when the unit is assembled, an annular recess 44, best seen in FIGS. 2 and 4, is provided in the angled fluid passage 36. An oversized O-ring or other seal 45 is placed within the annular recess 44 and will create a fluid tight seal against the opposed surfaces in the slot 32 when the unit it attached.

From the above detailed description of the above embodiment of this invention, it will be seen that the adapter units 12 and 34 thus described can be assembled and disassembled from above the ground and are simple in construction with only two parts which slidingly fit together, relying on the weight of the unit to hold them in place It will also be seen, particularly from inspection of FIG. 2, that when the unit is disassembled, the entire inner diameter of the well casing 10 is completely free of obstruction with absolutely no projection on the upper portion 18 of the annular seat 15 extending within the casing 10. This feature is made possible by choosing the angle A to be in the range of 22° to 25°, and preferably 25°. It will also be seen that the unit, because of its design, is capable of supporting very large pump and pipe weight because it does not rely upon solely an external attachment means to the pipe casing, but rather rests a substantial portion of its weight on the wall forming aperture 11 in the pipe casing 10. In addition, first unit 12 is designed with improved sealing capability which can be monitored by an early leakage detection system, as described above. Finally, it will be seen that the unit provides automatic alignment of the vertical pipe 38 because of its angular relationship of the passage 32 and flange 37. It might be noted that this alignment is not effected by tightening or loosening of the nuts 27 on bolts 26 which are positioned in a horizontal plane on either side of the first unit 12 and do not effect the angle of the blind passage 32 with respect to the vertical.

Various alternatives and embodiments are contemplated as being within the scope of the following claims particularly pointing out and distinctly claiming the subject matter regarded as the invention.

I claim:

1. In a well casing having a constant diameter, a longitudinal axis, an exterior surface, an interior surface and an aperture formed therein, a first unit secured to the exterior surface of the constant diameter well casing and including a horizontal fluid passage receiving a horizontal pipe and extending through a generally annular seat in registration with the aperture, the annular seat having a blind channel formed therein, and a second unit disposed within the interior surface of the constant diameter well casing for supporting a vertical pipe and a pump and having a generally planar flange adapted to be slidably received in the blind channel of the first unit at an angle relative to the longitudinal axis of the constant diameter well casing to provide a continuous fluid passage between the vertical pipe and the horizontal pipe, the improvement wherein:

the annular seat of the first unit is completely recessed from the inner surface of the constant diameter well casing such that upon release of the second unit from the first unit, the second unit and the pump are movable in a totally obstruction-free path throughout the interior surface of the constant diameter well casing.

2. The improvement of claim 1, wherein the angle between a plane passing through the blind channel and the annular seat and the longitudinal axis of the well casing is in the range of 22° to 25°.

3. The improvement of claim 1, wherein the first unit includes a curved lip engaged against the exterior surface of the well casing and forming an annular pocket lying outside the aperture formed in the well casing, and a pair of concentric gaskets retained in the pocket to define a fluid-tight seal between the first unit and the well casing.

4. The improvement of claim 3, wherein the first unit further includes a fluid port connecting the horizontal fluid passage with the pocket such that fluid in the horizontal passage is communicated to a space between the concentric gaskets retained in the pocket.

5. The improvement of claim 4, wherein the curved lip, the pocket, the concentric gaskets, and the fluid port collectively define an early warning leak detection arrangement constructed and arranged to signal by visual observation a fluid warning upon damage and destruction to at least one of the concentric gaskets and the engagement of the curved lip against the exterior surface of the well casing.

6. The improvement of claim 1, wherein the annular seat has a lower periphery with a supporting lip which rests on a rim of the aperture, and an upper periphery which extends to the rim of the aperture and lies spaced from the inner surface of the well casing.

7. A well adapter used in a well casing formed with an aperture and having a constant diameter, an exterior surface, an interior surface and equipped with a pump, the well adapter comprising:

an external unit removably secured to the exterior surface of the constant diameter well casing and including a sleeve having a horizontal fluid passage receiving a horizontal pipe and extending through a generally annular seat in registration with the aperture, the annular seat having a blind channel formed therein and extending at an angle downwardly and outwardly relative to the interior surface of the constant diameter well casing; and an internal unit disposed within the interior surface of the constant diameter well casing for supporting a vertical pipe to which the pump is connected and including a generally planar flange adapted to be slidably received in the blind channel of the external unit at the angle of the blind channel, wherein the upper periphery of the annular seat lies completely recessed from the inner surface of the constant diameter well casing so as to create a totally obstruction-free path for the pump during installation and repair; and wherein the external unit has an internal structure in the form of a curved lip engaged against the interior surface of the well casing and forming a pocket lying outside the aperture formed in the well casings and a sealing arrangement in the form of a pair of unconnected concentric gaskets retained in the pocket and completely encased by the curved lip so as to protect the gaskets from exposure to external environment, the sealing arrangement being disposed outside the aperture at an interface between an inner surface of the external unit and the exterior surface of the constant diameter well casing, the internal structure and the sealing arrangement being cooperable by visual observation to signal a fluid warning upon damage and destruction to at least the sealing arrangement.

* * * * *